US005224799A

United States Patent [19]

Parker

[11] Patent Number: 5,224,799

[45] Date of Patent: * Jul. 6, 1993

[54] PERMANENTLY INSTALLED BUILDING FOUNDATION FORM

[76] Inventor: Alton F. Parker, 8 Hiawatha Dr., Clifton Park, N.Y. 12065

[ * ] Notice: The portion of the term of this patent subsequent to Jun. 9, 2009 has been disclaimed.

[21] Appl. No.: 878,619

[22] Filed: May 5, 1992

Related U.S. Application Data

[63] Continuation-in-part of Ser. No. 592,358, Oct. 3, 1990, Pat. No. 5,120,162.

[51] Int. Cl.[5] ..... E02B 11/00; E02D 15/02

[52] U.S. Cl. ..... 405/229; 405/45; 52/169.5; 52/426; 52/294; 285/64

[58] Field of Search ..... 405/36, 43, 44, 45, 405/229; 52/169.5, 426, 425, 427, 294, 742; 285/64

[56] References Cited

U.S. PATENT DOCUMENTS

| | | | |
|---|---|---|---|
| 994,155 | 6/1911 | Harris | 405/43 |
| 3,017,722 | 1/1962 | Smith | 50/100 |
| 3,613,323 | 10/1971 | Hreha | 52/169 |
| 4,185,429 | 1/1980 | Mendola | 52/274 |
| 4,524,678 | 6/1985 | Klebanoff | 285/64 X |
| 4,832,557 | 5/1989 | Jacobsen | 411/485 |
| 5,120,162 | 6/1992 | Parker | 52/169.5 X |

FOREIGN PATENT DOCUMENTS

| | | | |
|---|---|---|---|
| 1939091 | 1/1971 | Fed. Rep. of Germany | 52/426 |
| 2152422 | 6/1972 | Fed. Rep. of Germany | 52/426 |
| 116913 | 9/1980 | Japan | 405/43 |
| 397590 | 1/1974 | U.S.S.R. | 405/43 |
| 1161642 | 6/1985 | U.S.S.R. | 405/43 |

*Primary Examiner*—David H. Corbin
*Assistant Examiner*—Arlen L. Olsen
*Attorney, Agent, or Firm*—Schmeiser, Morelle & Watts

[57] ABSTRACT

A permanently-installed form-drain (10) including hollow, foraminous planks (12) and connectors (16,18) for joining two or more of the planks in a continuously arranged concrete barrier. The instant improvements include an adapter (20/21), which serves as a straight connector, grooved plank (19) with interlocking stake (13/14), integral connector-stake and adapter-stake device (16/14, 20/14) and a tri-functional, generally rigid bracket and bracket-stake (22 and 22/22x) element, used to space and restrain/constrain the planks and/or to hold (support) reinforcement bars.

12 Claims, 3 Drawing Sheets

PERMANENTLY INSTALLED BUILDING FOUNDATION FORM

This is a Continuation-in-Part of U.S. patent application Ser. No. 592,358 filed on Oct. 3, 1990, now U.S. Pat. No. 5,120,162.

BACKGROUND OF THE INVENTION

1. Field of the Invention

This invention relates generally to structural footing forms and footing drains, and in particular, to a permanent concrete footing/foundation form having integral drain means and diverse connector elements. The instant invention improves on the connector elements of the genre.

2. Relevant Art Discussion

Forms comprising a plurality of planks, of varying lengths and having therein a plurality of foramens, are joined in straight or angular relationships to initially lay out the periphery of a building foundation or footing. It is a primary purpose of the forms in this invention to provide a containment for concrete which is to be poured as the footing or foundation of a building. Generally, two peripheral forms are used in spaced-apart, parallel array and the concrete disposed therebetween. Such is the thrust of my prior U.S. patent application Ser. No. 592,358 filed on Oct. 3, 1990, now U.S. Pat. No. 5,120,162, hereinafter incorporated by reference. To aid in the establishment of a structurally rigid footing/foundation form having integral drainage means, I have since improved the entire ensemble by providing adjunct mechanisms for the discrete connecting elements and by providing alternate spacer/constraining apparatus, the latter to be used with a full form ensemble, i.e. an inner and an outer form arrayed as aforesaid.

Prior to my initial introduction of the integral foundation form-drain, some work had been done in the field to provide the tradesman with a permanently-installed footing or foundation form. U.S. Pat. No. 3,613,323, issued to Hreha in 1971 inculcates a combination footing and drainage form in which the drainage means is integral with the essentially planar form. Hreha teaches the mitering of the forms so as to define and set out a completed, continuous building form. Holding the forms in place is accomplished by ordinary stakes which are literally driven through the conduit means of the ensemble by means of holes therein. Hreha teaches no particular technique which will accomplish the rapid spacing of the opposing foundations forms. The presence of staking holes further limits the Hreha teaching. In 1962, Smith was issued U.S Pat. No. 3,017,722 for his teaching of a hollow stringer element which could suffice as a partial foundation form and aid in the footing drainage scheme. Like Hreha, whom he preceded, Smith taught nothing novel in the ways for constraining the forms in place and was silent, also, concerning means for providing continuity of drainage via connector elements.

My initial contribution to this art clearly avoided the limitations of Hreha and Smith, as well as many others who have attempted to provide concrete footing/foundation forms having an integral drainage means associated therewith so that they could be left in place to be thereafter used as footing/foundation drainage means.

SUMMARY OF THE INVENTION

I have improved the aforementioned original connectors and spacing apparatus of my initial invention. To aid in the form setup, while providing continuity of flow about the periphery of the prospective foundation, several connectors are employed to join together a series of hollow plank elements. The planks are foraminous on at least one side which faces outward or away from the space reserved for the pouring of concrete therein. I generally prefer to employ foramens or perforations only at the non-concrete receiving side. All other surfaces of my plank unit are continuous and generally nonforaminous. Concomitantly, grooving is continuous wherever used, but foramens placed only at a side.

The connectors that are to be used with the aforesaid planks are cross-sectionally adapted for their connection with the planks. Since brick or stonework generally resides on the concrete only, and not on the top surface of the form-drain and connectors per se, the only strength and rigidity required of the completely formed ensemble (planks, connectors and stake means) is that necessary to inhibit separation of an inner form or an outer form by translating away from each other as the dense mass of concrete is poured between them. Thus, the instant improvements are directed toward the goal of further inhibiting such distortion or translation of the inner/outer peripheral forms, while also assisting in the setup and that rigidification of the form which precedes the concrete pouring process. The instant improvements number four: connector-plank end adaptation; a plank-stake interlock feature; a compound stake-connector element; and a highly useful tri-functional spacer/support/restrainer. The first of these is a clear definition of the plank-engaging means borne by the connectors of the instant invention. Because the planks may be cut to any desired size, it is necessary that any joining means be placed on the less mutable elements of the invention, the connectors, whether straight or angled. Preferably, I use an adaptive connector that obviates the need to provide the usual angle connectors or planks with connection or coupling means. This adapter (as I choose to term it) also acts as a straight connector of the aforesaid original disclosure, thus replacing it with a dual-purposed improvement. It is essentially a short piece of the same hollow cross-sectional shape as the basic planks and angle connectors. The adapter outer periphery, however, is smaller, so that it will slip into an angle connector or a plank, making therewith a close fitting. Additionally, about midway on this adapter, there is provided a collar having peripheral (outer) measurement close to that of the other pieces, planks and connectors. The improvement also conceives of a modification of each connector end, a second embodiment comprising a connector having approximately the same external periphery as the planks and a tongue extension of plank inner periphery size adapted to engage the plank inner periphery in an arm/sleeve relationship. The (third end) alternate embodiment of the aforesaid device is the provision of each connector end with an extending lip or overhang about its complete periphery so as to envelope the end of a plank, again in an arm/sleeve or mortise/tenon relationship. The latter of these embodiments will, of course, require a slightly oversized connector. The reader may readily discern why the adapter is favored.

The second of the aforementioned improvements consists in a stake, ordinary in most ways with the singular exception being that the top is folded over at right angles, twice, in order to give the stake a front elevation cross-sectional appearance of an inverted "L". Correspondingly, the top of the plank is continuously and longitudinally grooved to accept therein the folded over, short leg of the inverted "L"-shaped stake.

The third improvement is a compound stake-connector wherein the stake means is either made integrally with the connector and adapter elements or affixed after the molding of an element is completed. Depending upon the actual molding process used to produce the adapters/connectors, or subsequent stake fixation means, it is the integrated aspect of the improvement that I inculcate here.

Finally, perhaps the most useful improvement in my form-drain concept is the application of a spacer/support/restrainer of a type that could be used to obviate the aforementioned second and third improvements which relate only to stake or restrainment devices. This tri-functional device consists essentially in a non-biodegradable, pest-resistant material shaped from an elongate, essentially flat element and/or formed into the upper portion of a castellated surface. Thus, the lateral "legs" of the castellated surface provide a restraining (staking) facility (or emulation) while the horizontal member provides a support, constraining and spacing facility. I employ the support member to hold reinforcement bars (re-bars) and the length of the horizontal member in conjunction with the legs to provide spacing, as well as restraint/constraint of the forms over which they fit. Further reference to the drawings will readily clarify the nature of these improvements.

DETAILED DESCRIPTION OF THE IMPROVEMENTS

The instant invention comprises, essentially, four improvements to an invention comprising an in situ and permanently set building foundation form which includes integral drainage means. The elements of the aforementioned original invention are composed of non-biodegradable materials which possess inherent rigidity and strength the equivalent of, or superior to, the wood planks that are presently used for foundation or footing forms. By means of the appended drawings, the original invention shall be set forth succinctly and a more detailed disclosure of the instant improvements made thereinafter.

Figure 1:
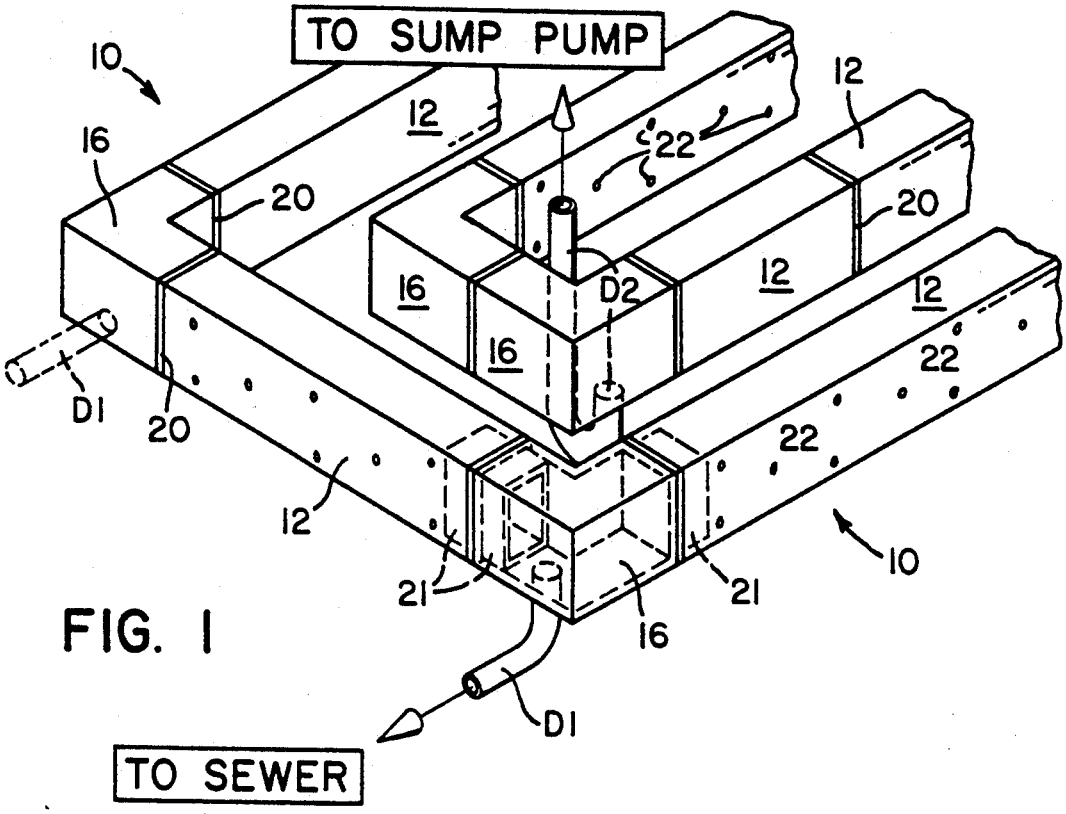
FIG. 1 is an isometric illustration of a partial footing form emplacement using some of the instant invention improvements.

Referring particularly to FIG. 1, a partial isometric illustration details the salient elements of the original invention 10 which comprise a series of elongate, hollow planks 12 which are joined together to form the outer periphery and inner periphery of a foundation form. The planks are foraminous, i.e. bear a plurality of foramens 22, on one side thereof, that side being the one facing away from the area lying between the inner and outer peripheral forms. Connecting the hollow planks 12 so as to provide angular definition to the peripheral form, while also providing continuity (of water flow) through a series of joined planks 12 are a series of corner connectors 16. The corner connectors are shown in this instance as containing, in selected locations, drainage means D1 and D2. The D1 drains are taken from either the bottom or the side of an angle connector 16 and vent the accumulated water to appropriate sewage means. The drain denoted D2 may likewise be taken from the bottom or side of an angle connector (or any form of connector) and, because it drains the inner peripheral form, is generally vented to a sump pump. The first notable distinction that will be recognized as existing between the original invention disclosure in U.S. Pat. No. 5,120,162 and the instant is the improvement of providing plank and/or connectors with removable at the ends thereof for joining to other elements of the invention. I have devised what I term an adapter 20/21 which is used to join any of the salient elements, planks or connectors, to each other, irrespective of the length of either. Hereinafter, these unique adapters will be disclosed in greater detail and also in conjunction with the disclosure of special stakes 14 (not shown) of the invention. Relative to the stake means of the invention 10, originally I used a non-biodegradable stake (as are all elements of the invention) and merely used it at either the inner or outer sides of the planks 12. The sole purpose of the stake was to constrain the planks from any translational movement that would allow distortion of the form (consequently, the footing) as the concrete was being poured. As shall be hereinafter disclosed, my stake improvement of the instant invention allows stakes to be placed with a single orientation (outside or inside the concrete depository) as well as providing a means for adjusting the height or level of the form framework.

Figure 2:
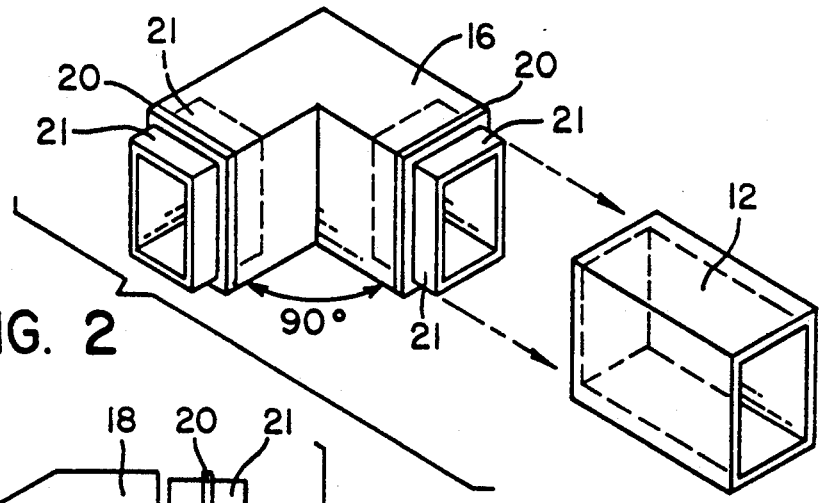
FIG. 2 is a right angle connector bearing on the periphery of each end a connecting improvement called an adapter.
Figure 3:
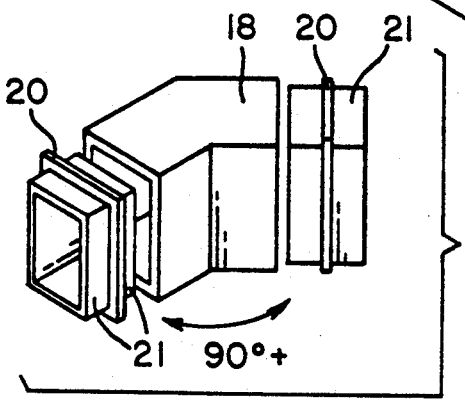
FIG. 3 is the FIG. 2 improvement used with an obtuse connector.

FIG. 2 is an isometric illustration depicting a right angle connector 16 having both ends adapted with extensions 21 of a cross-sectional shape and outer periphery sized to fit snugly within the inner (or sleeve portion) of a plank 12. Those of ordinary skill will readily discern that the connector 16 may be manufactured with the tongue like inner peripheral extensions 21 or such may be added, as herein disclosed, by use of an adjunct connector element, called an adapter 20/21. The adapter 20/21 shown herein is more clearly depicted in FIG. 3, but the salient characteristics thereof are readily discerned in FIG. 2, as well. In FIG. 3, the adapter 20/21 is a short, hollow plank increment having an outer periphery 21 sized to fit into a regular plank 12 or connector 16 interior. A collar 20 is provided about midway and integrally formed with the smaller element 21. Reference to FIG. 3 discloses an obtuse connector 18 bearing an adapter 20/21 at each end thereof, poised for insertion thereinto. Earlier, I mentioned that the instant improvement (adapter 20/21) replaces the original integral straight connector of my original invention.

It may be readily seen now that, by using the adapter, the dual function of straight connector and end joining means for the other elements 12,16,18 is readily acquired. Further, ease of manufacture is greatly enhanced and an original invention concept, that of making connector ends larger so as to fit over the ends of the planks 12, retains little manufacturing viability. By use of the presently disclosed adapter 20/21, it now becomes possible to cut the ends of both planks and connectors and still retain the capability of readily joining these elements to other cut or uncut elements. Additionally, the width of the collar 20, a design character normally used to provide equal depth of spacing for an inserted adapter 21, may be varied so as to further functionalize its presence (see FIG. 5*b*).

Figure 4A:
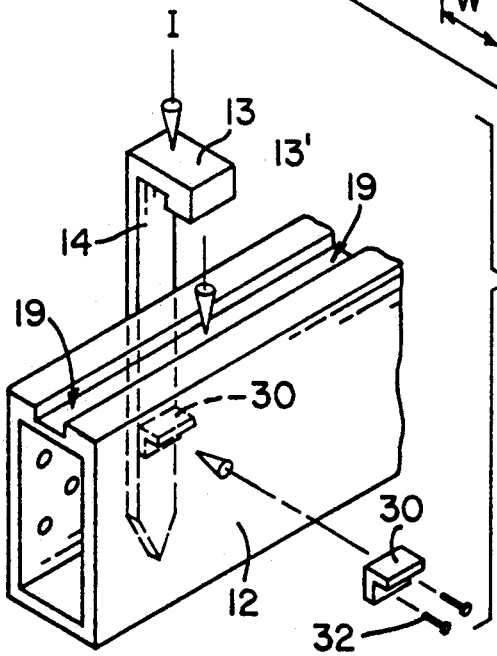
FIGS. 4*a* and 4*b* isometrically represents stake and plank improvements.
Figure 4B:
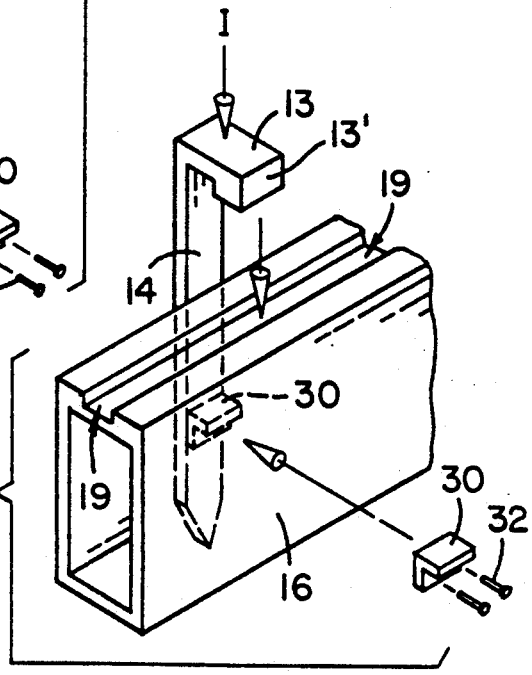

As mentioned above, stake 14 of the instant invention comprises an improvement over the originally disclosed non-biodegradable stakes. Further, the improved stake 14 compels a modification of at least one surface, ,top or bottom, of the plank or connector 12/16. In FIGS. 4*a* and 4*b*, the stake 14 of the instant invention is shown in isometric portrayal comprising a top extension 13 which is folded into a right angle and then into another right angle 13' so as to form a stake having the shape of an inverted "L". Impact I is made on the stake at the location depicted by the arrow and the groove modification 19 of the plank/connector 12/16 is shown in a position receptive of the shorter leg 13' of the stake 14. It should be readily understood by the reader that continuous groove 19 in plank and/or connector 12/16 may be placed in both top and bottom portions of these elements, thus retaining the original elemental function of invertability and the characteristic of cross-sectional symmetry about a central horizontal axis or plane. Such symmetry, as originally conceived, allows complete interchangability of the invention elements, irrespective of the posture in which one (plank adapter or connector) is placed. An adjunct to the stake 14 mechanism is the optional addition of bracket 30, which may be either formed integrally with the stake 14 or affixed subsequent to stake production by means of adhesive (not shown) or screws 32. The function of bracket 30 on a stake 14 is to provide a ledge which, in combination with the stake upper or head portions 13/13' and plank and/or connector 12/16 groove means 19 may be used to securely hold the stake 14 to a plank 12 or a connector 16 so that it may be restrained against translational movement and readily adjusted in height.

Figure 5A:
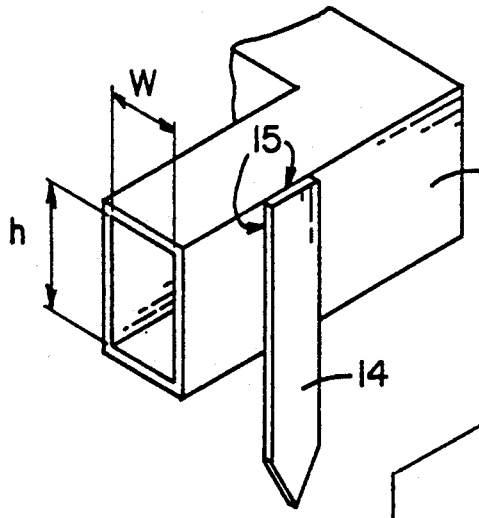
FIGS. 5*a* and 5*b* are isometric illustrations of integral stake/connectors.
Figure 5B:
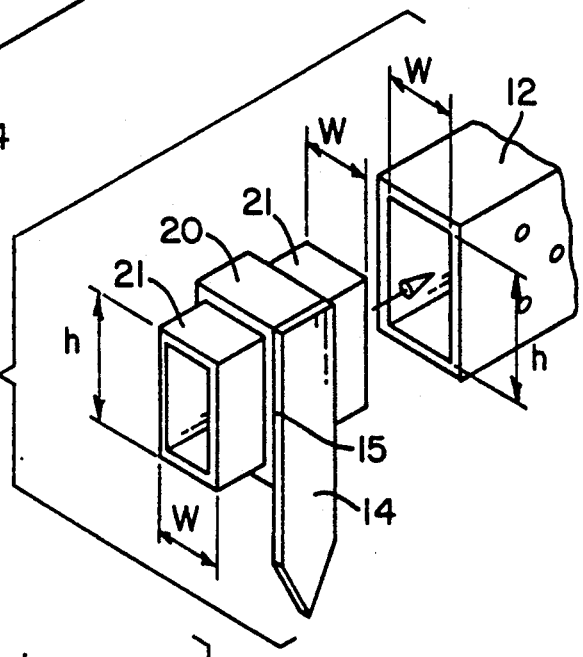

Like FIGS. 4*a* and 4*b*, FIGS. 5*a* and 5*b* portray a stake 14 improvement comprising the integral formation of a stake 14 with a connector 16 or an adapter 20/21. In FIG. 5*a*, the stake 14 is depicted bonded at 15 to connector 16. It should be understood by the reader that such bonding may be either illustrative of an integral fabrication of stake 14 with the element 16, or one which is later "welded" by the use of adhesive or other chemical binders. Also depicted is the inner height h and width w of the connector 16, which dimensions are pointed out further in FIG. 5*b*. Relative to FIG. 5*b*, adapter 20/21 is depicted in isometric showing the same essential characteristics as FIG. 5*a* relative to stake 14, bond or weld 15 and the integral formation of the stake 14 with the adapter element 20/21. As previously mentioned, dimensions h and w relate to the outer peripheral dimensions of adapter ends 21 and are essentially equal to the inner peripheral dimensions of the plank 12. Also as previously mentioned, the collar 20 of the adapter is wider than initially shown in order to accommodate the wider stake 14, integrally formed with or bonded thereto.

Figure 6:
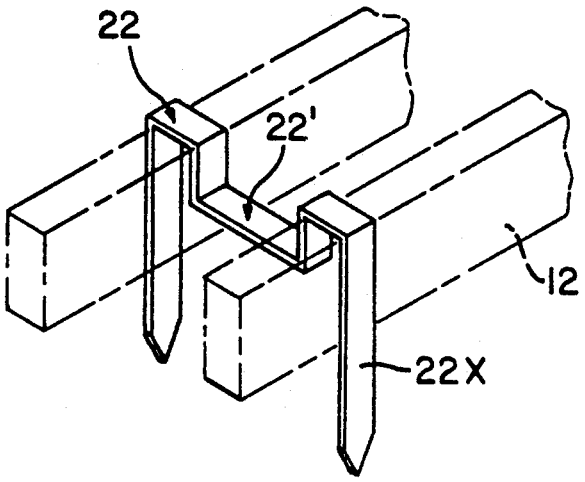
FIG. 6 is an isometric illustration of the tri-functional spacer/support/restrainer installed with opposed planks of the invention.
Figure 7:
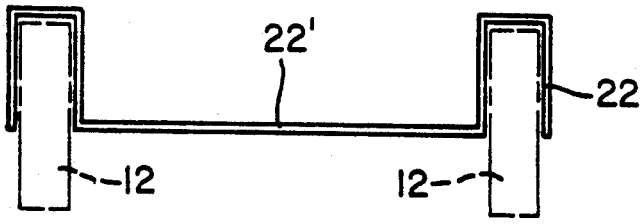
FIGS. 7 and 8 are frontal elevations of the FIG. 6 device, in alternate forms at the transverse "bar" portion.
Figure 8:
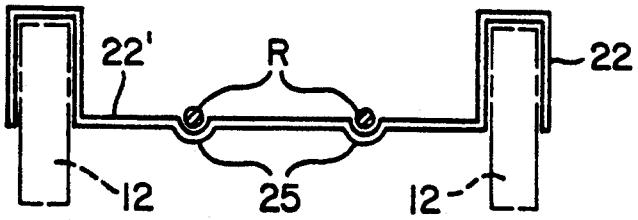

Turning now to FIGS. 6–8, I would draw the reader's attention to what I term a tri-functional element which comprises the fourth improvement to my original invention. In the original invention, I used adjunct mechanisms such as spacing devices (constraints), which comprised cord-like attachments to the planks 12 and, which constrained the planks from separation or translation but a modicum, while ordinary stakes were used as restraints and provided the primary means for obviating such translation. Thus, the cords or constraints served primarily as spacing elements and the stakes as restraining elements therefor; and the planks, in conjunction with the connectors, served to support themselves exclusive of any other aids or elements. Furthermore, by "support", I referred originally to support of the planks only and not of other mechanisms, such as reinforcement bars (re-bars), which often have to be inserted into the foundation forming scheme. Thus, three functions—spacing, constraint/restraint and support of adjunct mechanisms such as re-bars—when fulfilled by a single element become an invention in itself which is widely adaptive to other forms of art that may employ the basic concepts of the aforementioned earlier artists Hreha, Smith and myself. FIG. 6 depicts such a tri-functional device 22 in isometric illustration, displaying the device 22/22'/22*x* as it would appear postured with two parallel disposed planks 12, as shown here in phantom. In frontal elevation, this device has a castellated shape wherein the lateral legs enclose a plank 12, the transverse bar 22' provides both a separation gauge and constraint against lateral translation of the planks 12 while also providing support for re-bars and the like, and the lateral leg extensions 22*x* provide the pointed, soil penetrating portions of the device, thus lending it a true restraint (stake) character thereto. As the reader will readily note, this singular embodiment literally discloses the instant invention improvement with all of its functional attributes.

FIGS. 7 and 8 illustrate diminutive versions of the FIG. 6 device, lacking only the soil-penetrating extension 22*x* and, as seen in FIG. 8, containing the dimpled portions 25 which allow re-bars R to be set therein. All other characteristics bear the same numeric nomenclature as that device of FIG. 6. Depending upon the materials chosen to fabricate the tri-functional device, one can expect to obtain full functionality. For example, if the device were to be made of stainless steel or heavy gauge aluminum, it would provide the non-biodegradability which is desired for the permanent installation of the form-drain 10. Concomitantly, when configured as shown in FIG. 6, with perhaps the re-bar support of FIG. 8, its full functionality would be realized in that it would provide plank 12 spacing, constraint/restraint and support for rebar devices. It may also be readily surmised, for example when considering a FIG. 7 type of installation, that the tri-functional device 22/22' may be inverted so that the lateral portions thereof accept and securely grip the planks 12 from below rather than from above. Again, depending upon the strength of the materials chosen to fabricate this element, the inverted FIG. 7 illustration would require little or no staking. Re-bars R could still be installed on the device sans dimpled grooves 25 simply by wiring the re-bars R along the transverse portion 22'. If complete flexibility is desired in the emplacement of the FIG. 7 element, as well as the dimpled groove 25 for re-bar emplacement, the dimpled groove may be effected by giving it a sinusoidal shape (in cross section) so that the dimpled grooves 25, as shown in FIG. 8, would appear as a sine wave, curving both below and above the transverse portion 22'. Those of ordinary skill shall undoubtedly conceive of many variations on the basic concepts that I have herein presented.

The foregoing concepts and improvements to my original invention have served to greatly enhance the installation of the basic mechanisms. All are comprised of non-biodegradable materials so that the form-drain 10 will provide an excellent form means for initial concrete emplacement, while continuing to function for decades as a footing/foundation drain. Installation costs will be greatly minimized in that the labor-intensive tasks of foundation installation, form removal and time-consuming drainage installation will be virtually eliminated. Layout of my form-drain invention requires only two basic tools, an impacting mechanism (sledge) and a cutting implement (e.g., a circular saw). Spacing of the inner and outer peripheries of the form, constrainment-/restrainment and emplacement of re-bars are all accomplished with, as a minimum, the adapter 20/21 of FIG. 3 and the tri-purposed element 22/22' of FIGS. 7 or 8. Other embodiments of these devices will serve to make the task easier and more adaptive, as an installation situation might warrant. Routineers in the building trades will find the present invention and improvements thereto to be of inestimable value, particularly in the building of tract homes, condominiums and the like. Such is commended to their usage consistent with the hereinafter appended claims.

What is claimed is:

1. A hollow multi-elemental, permanently installed concrete form-drain comprising in combination:

a plurality of hollow, essentially rectilinear and elongate planks, said planks being foraminous on one side thereof, nonforaminous on the other side, essentially continuous at a bottom thereof and having interior symmetry about a horizontal central plane;

at least one preformed hollow, non-plank connecting element for joining two or more said planks in an end-to-end configuration, said connecting element possessing a cross-sectional symmetry and means for fitting said element to an end of one of said preformed hollow planks, connection of multiple planks with multiple connecting elements resulting in a continuous form having an inner peripheral structure and an outer peripheral structure of containment of concrete between the structures, said connection providing continuous drainage through and about the structures; and means for rigidly securing two or more said planks in parallel spaced-apart relationship to form an integral concrete foundation form so that the foraminous side of said planks face such that they provide inside and outside foundation peripheral drainage means.

2. The form-drain of claim 1, wherein said means for fitting includes an adapter.

3. The form-drain of claim 2, wherein the adapter further comprises flange means at an end thereof adapted to slide into a plank end.

4. The form-drain of claim 3, wherein the adapter further comprises a collar means transversely disposed peripherally and approximately midway thereabout.

5. The form-drain of claim 4, wherein the collar means further includes a stake.

6. The form-drain of claim 1, wherein the connecting element includes an integral stake.

7. The form-drain of claim 1 further comprising an "L" shaped stake, and planks and/or connecting elements having a continuous longitudinal groove, at least on the top thereof, for accepting thereinto a portion of the stake.

8. The form-drain of claim 7, further characterized by a ledge means disposed between a head and tip of the stake.

9. A hollow multi-elemental, permanently installed concrete form-drain comprising in combination:

a plurality of preformed hollow, essentially rectilinear and elongate planks, said planks being foraminous on one side thereof, nonforaminous on the other side, essentially continuous at a bottom thereof and having interior symmetry about a horizontal central plane; and at least one preformed hollow, non-plank connecting element for joining two or more planks in an end-to-end configuration, said connecting element possessing a cross-sectional symmetry for fitting said element to a plank end so that connection of multiple planks with multiple connecting elements results in a continuous form having an inner peripheral structure and an outer peripheral structure for containment of concrete between the structure while, concomitantly, said connection provides continuous drainage through and about the structures; and a bracket means having a castellated shape wherein said bracket means includes lateral portions possessing a hollow rectilinear shape to partially circumscribe and enclose a portion of a plank and to hold two said planks in essentially spaced-apart, parallel relationship on an earthen surface, a cross bar of said castellated shape being disposed relative to said lateral portions at a desired height above the surface to orient and support reinforcement bars thereon.

10. The form drain of claim 9, wherein the bracket includes at least one outside lateral portion extended to effect a stake.

11. Means for securing two planks of a concrete form in rigid, spaced-apart relationship comprising a bracket with a castellated shape the two lateral portions thereof each possessing a continuous rectilinear geometric shape which partially circumscribes and encloses a portion of a plank so as to hold a plank pair in essentially spaced-apart, parallel relationship on the ground, a cross bar of said castellated shape being disposed relative to said lateral portions at a desired height above the surface to orient and support reinforcement bars thereon.

12. The means for securing of claim 11, wherein the bracket further includes at least one outside lateral portion extended to effect a stake.

* * * * *